US010580607B2

(12) United States Patent
Antonello et al.

(10) Patent No.: US 10,580,607 B2
(45) Date of Patent: Mar. 3, 2020

(54) ELECTRONIC PROTECTION DEVICE

(71) Applicant: ABB Schweiz AG, Baden (CH)

(72) Inventors: Paolo Antonello, Arluno (IT); Agostino Butti, Vittuone (IT); Mauro Guerra, Vittuone (IT)

(73) Assignee: ABB Schweiz AG, Baden (CH)

( * ) Notice: Subject to any disclaimer, the term of this patent is extended or adjusted under 35 U.S.C. 154(b) by 72 days.

(21) Appl. No.: 16/060,984

(22) PCT Filed: Dec. 9, 2015

(86) PCT No.: PCT/EP2015/079136
§ 371 (c)(1),
(2) Date: Jun. 11, 2018

(87) PCT Pub. No.: WO2017/097355
PCT Pub. Date: Jun. 15, 2017

(65) Prior Publication Data
US 2018/0366290 A1 Dec. 20, 2018

(51) Int. Cl.
*H01H 71/46* (2006.01)
*H01H 71/52* (2006.01)
*H01H 71/04* (2006.01)

(52) U.S. Cl.
CPC ..... *H01H 71/46* (2013.01); *H01H 71/04* (2013.01); *H01H 71/526* (2013.01); *H01H 2071/042* (2013.01)

(58) Field of Classification Search
CPC ..... H01H 71/46–71/48
See application file for complete search history.

(56) References Cited

U.S. PATENT DOCUMENTS 6,654,219 B1 11/2003 Romano et al.
2005/0103613 A1 5/2005 Miller
(Continued)

OTHER PUBLICATIONS

European Patent Office, International Search Report & Written Opinion issued in corresponding Application No. PCT/EP2015/079136, dated Jul. 22, 2016, 10 pp.

*Primary Examiner* — Ramon M Barrera
(74) *Attorney, Agent, or Firm* — Taft, Stettinius & Hollister; J. Bruce Schelkopf

(57) ABSTRACT

An electronic protection device for a LV electric line including at least a phase conductor and a neutral conductor, comprising: input terminals and output terminals, at which said electronic protection device is electrically connected respectively with an electric power source and with an electric load through said phase and neutral conductors; a control unit comprising a controller including data processing resources; one or more pairs of main contacts electrically connected with corresponding one or more input and output terminals and adapted to be mutually coupled or separated; one or more pairs of auxiliary contacts electrically connected with corresponding one or more input terminals and with said control unit and adapted to be mutually coupled or separated; a handle movable in a first position corresponding to a closed state of said electronic protection device, in a second position corresponding to a tripped state of said electronic protection device or in a third position corresponding to an open state of said electronic protection device; an operating mechanism adapted to operate said main contacts, said auxiliary contacts and said handle; a tripping unit adapted to actuate said operating mechanism in response to an activation by said control unit. Said main contacts and said auxiliary contacts are coupled when said electronic protection device is in said closed state with said handle in said first position. Said main contacts are separated
(Continued)

and said auxiliary contacts are coupled when said electronic protection device is in said tripped state with said handle in said second position. Said main contacts and said auxiliary contacts are separated when said electronic protection device is in said open state with said handle in said third position.

20 Claims, 9 Drawing Sheets

(56) References Cited

U.S. PATENT DOCUMENTS

| | | | |
|---|---|---|---|
| 2007/0297113 | A1 | 12/2007 | Domitrovich et al. |
| 2009/0189719 | A1 | 7/2009 | Yang |
| 2010/0149711 | A1 | 6/2010 | Larson et al. |

ELECTRONIC PROTECTION DEVICE

The present invention relates to an electronic protection device for low voltage electric lines.

For the purposes of the present application, the term "low voltage" (LV) relates to operating voltages lower than 1 kV AC and 1.5 kV DC.

As is known, an electronic protection device for a LV electric line consists in an interrupter (e.g. a circuit breaker) equipped with an electronic control unit that typically includes a microcontroller.

An electronic protection device is intended to be operatively associated with the conductors of an electric line and is generally adapted to take three different operative states, namely a closed state, a tripped state and an open state.

Normally, an electronic protection device operates in the closed state, at which it enables the current flow between an electric power source and an electric load electrically connected by the electric line.

When it is in the tripped state or in the open state, the electronic protection device is able to interrupt the current flow along the conductors of the electric line.

Generally, an electronic protection device is designed to automatically pass (tripping) from the closed state to the tripped state in case fault conditions in the electric line or in the protection device itself are determined by the control unit.

Typical fault conditions may be, for example, ground fault conditions, arc fault conditions, overvoltage conditions, short-circuit conditions, short-delay states, and the like.

As is known, electronic protection devices for LV electric lines are typically self-supplied, i.e. they are designed to draw the electric power for feeding the control unit directly from the electric line without being equipped with a specific auxiliary power supply.

In currently available electronic protection devices, some examples of which are described in patent documents US2007/0297113, US2010/0149711, US2005/0103613, U.S. Pat. No. 6,654,219 US2009/0189719, this feature entails some limitations to their operative performances, in particular when the electronic protection device is in the tripped state.

When these devices automatically trip to interrupt the electric line, in fact, their control unit is not fed anymore and is no more able to operate.

Any HW resource included in the control unit is switched off and the microprocessor of the control unit is no more able to further process data and/or interact with devices operatively associated thereto.

As an example, any signalling device included in the control unit is switched off and the control unit is no more able to drive such a signalling device. The user is thus deprived of information related to possible fault conditions which may have caused the automatic tripping of the electronic protection device.

Technical solutions have been introduced in currently available protection devices to mitigate the problems deriving from the missing operability of the control unit when the electronic protection device is in a tripped state.

Unfortunately, they are still not decisive and offer some drawbacks.

As an example, in many electronic protection devices of the state of the art, the control unit is configured to continuously store relevant information related to the operating status of the electronic protection device in a non-volatile memory.

In this way, data related to possible fault conditions are saved before the electronic protection device trips and the electric power supply of the control unit is interrupted.

Stored information is then made available by the control unit (e.g. through the mentioned signalling device) as soon as the electronic protection device is brought again in normal conditions (i.e. in the closed state).

The major drawback of this arrangement resides exactly in that the user can access to the information related to possible fault conditions only after the electronic protection device is reclosed following a tripping event.

Unfortunately, if fault conditions are still present at the closing maneuver, the electronic protection device automatically trips again without providing the user with the information needed to understand the real nature of the faults causing the intervention of the electronic protection device itself.

In practice, the user will not have any useful information to correctly address possible maintenance interventions, if fault conditions persist.

A further drawback resides in the use of a non-volatile memory to store information collected by the control unit. Any failure of said memory (due to any reason, e.g. to the very same fault conditions having caused the tripping of the electronic protection device) may lead to a complete loss of the relevant information stored therein.

A further example of arrangement to mitigate the above described problems consists in providing the control unit with a bistable display to permanently display given information (such as information related to possible fault conditions causing a trip event) even when the control unit is no more fed due to the automatic tripping of the electronic protection device.

A drawback of this solution resides in that a bistable display having a size compatible with the normal dimensions of an electronic protection device is able to show only a small set of information.

Of course, larger bistable displays specifically designed for showing additional information may be arranged but this would entail an unacceptable increase of the overall size of the electronic protection device.

Yet an additional drawback of this solution resides in the high manufacturing time and costs.

The main aim of the present invention is to provide an electronic protection device that allows overcoming the mentioned technical problems of the state of the art.

Within the scope of this aim, an object of the present invention is to provide an electronic protection device, in which the control unit is still able to operate even when said electronic protection device is in a tripped state.

Another object of the present invention is to provide an electronic protection device able to provide the user with information related to the operating state of the electronic protection device and/or the electric line when the electronic protection device is in a tripped state.

Another object of the present invention is to provide an electronic protection device having a relatively small size with respect to currently available devices of the similar kind.

Another object of the present invention is to provide an electronic protection device highly reliable in operation and relatively easy to manufacture at industrial level, at competitive costs with respect to currently available devices of similar kind.

This aim, these objects and others that will become apparent hereinafter are achieved by an electronic protection device according to the following claim 1 and the related dependent claims.

Further characteristics and advantages of the invention will become apparent from the detailed description of exemplary embodiments of the electronic protection device, which is illustrated only by way of non-limitative examples in the accompanying drawings, wherein.

With reference to the cited figures, the present invention relates to electronic protection device 1.

The electronic protection device 1 is adapted to be operatively associated to a LV electric line 100.

The electric line 100 comprises one or more phase conductors P and a neutral conductor N.

In the embodiment shown in the cited figures, the electric line 100 comprises a single phase conductor P.

However, the skilled person will certainly understand that the electric line 100 may comprise a plurality of phase conductors, e.g. three phase conductors.

In the following, the electronic protection device 1 will be described with reference to its use in an electric line having a single phase conductor for the sake of simplicity only, without intending to limit the scope of the invention.

The electric line 100 is intended to electrically connect an electric power source SC and an electric load LD, which may be of any type.

The electronic protection device 1 is adapted to allow/interrupt a current flow between the electric power source SC and the electric load LD.

More precisely, the electronic protection device 1 is adapted to allow/interrupt a current flow between upstream portions 100A and downstream portions 100B of the electric line 100, which are electrically connected with the electric power source SC and the electric load LD, respectively.

Figure 1:
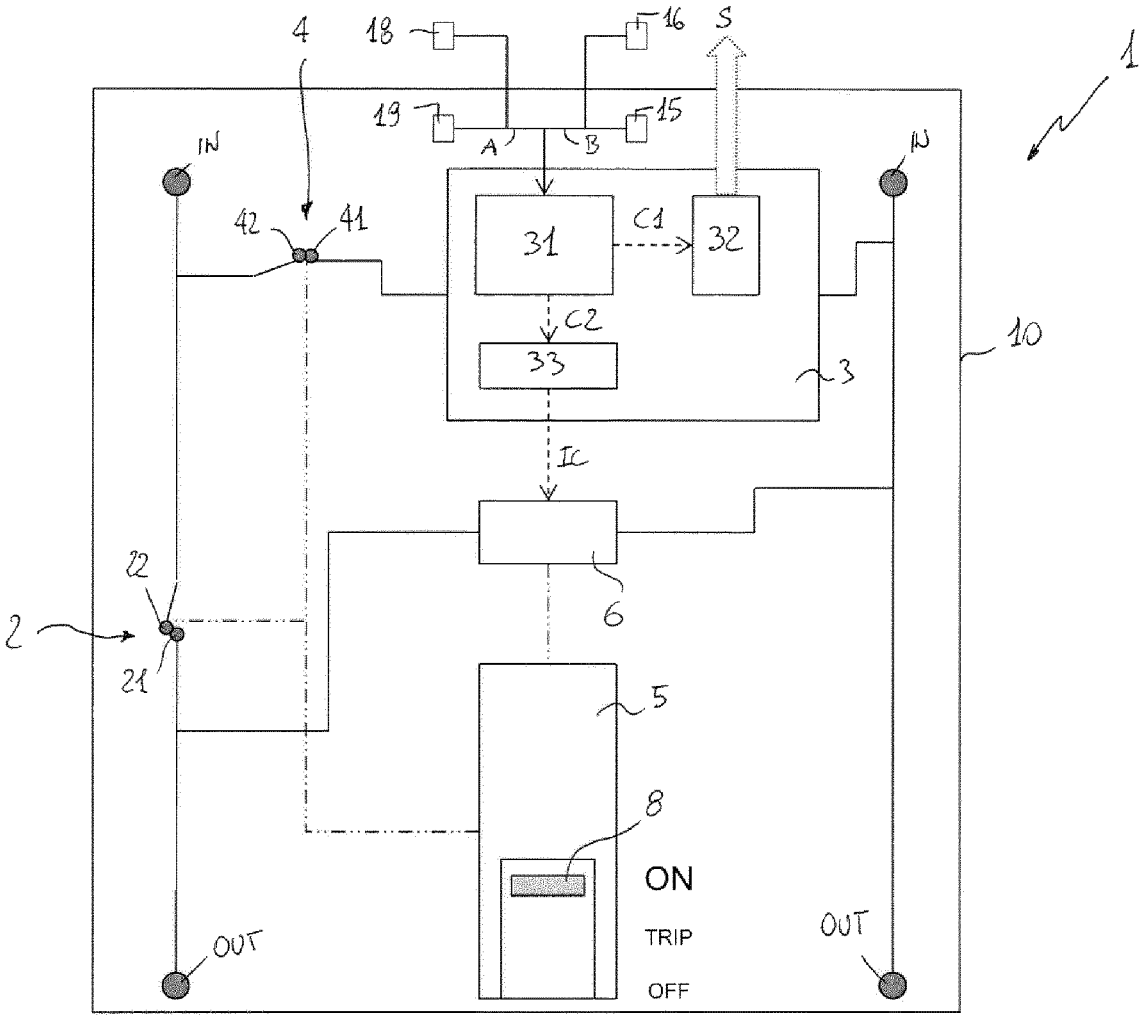
FIG. 1 is a block diagram of an embodiment of an electronic protection device, according to the invention, in a closed state.
Figure 2:
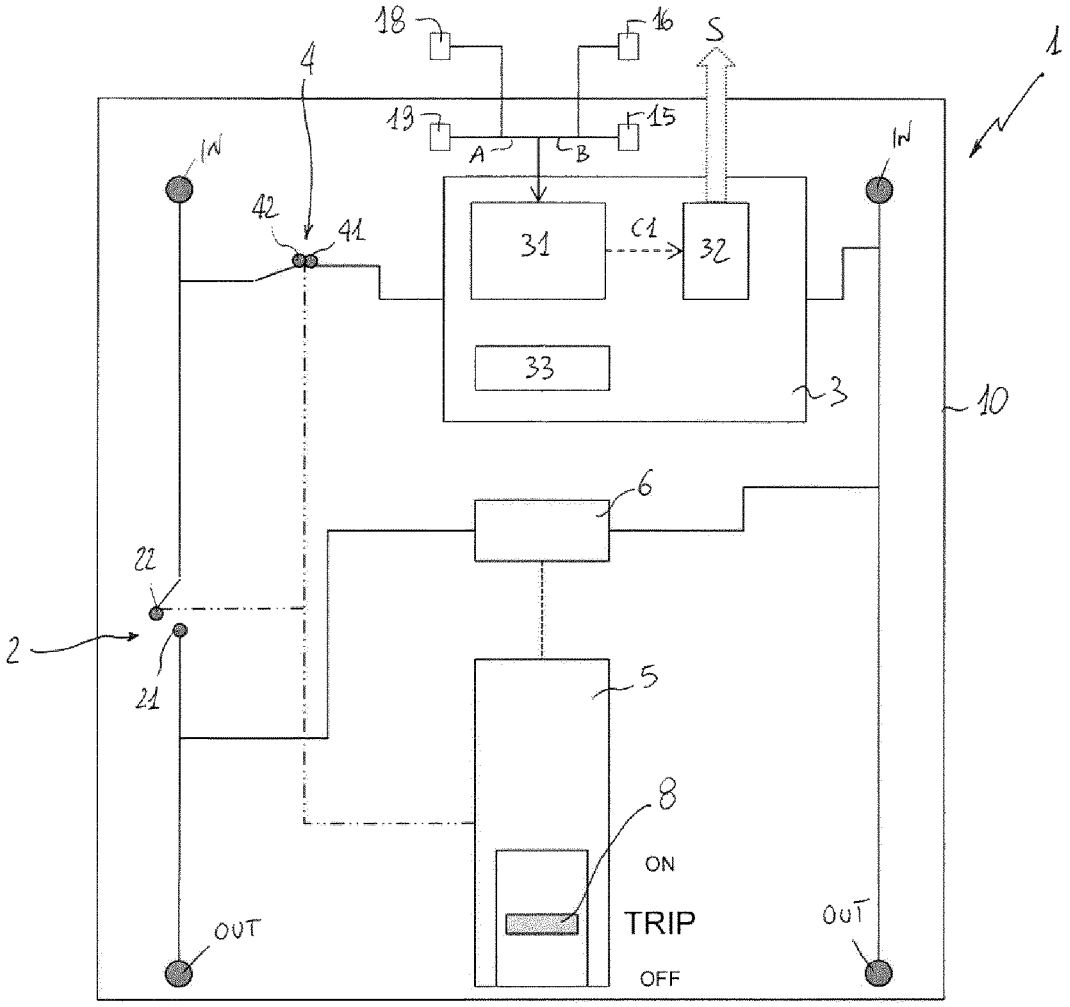
FIG. 2 is a block diagram of the electronic protection device of FIG. 1 in a tripped state.
Figure 3:
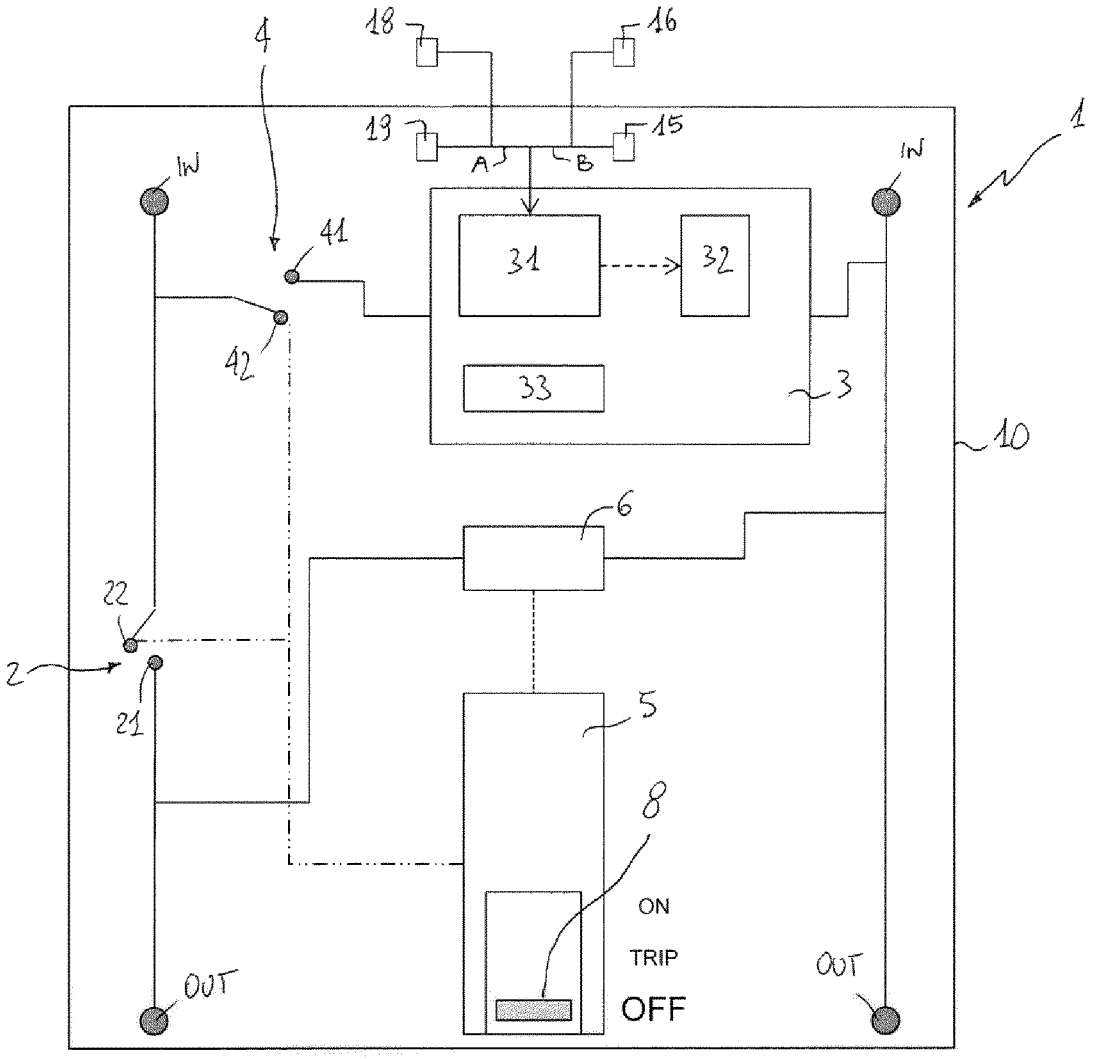
FIG. 3 is a block diagram of the electronic protection device of FIG. 1 in an open state.

In general, during its operating life, the electronic protection device 1 is adapted to take three different operative states, namely a closed state, a tripped state and an open state (FIGS. 1-3).

When it operates in the closed state, the electronic protection device 1 allows a current to flow along the electric line 100 between the electric power source SC and the electric load LD.

When it is in the tripped state or in the open state, the electronic protection device 1 is able to interrupt the current flow along the electric line 100.

The electronic protection device 1 comprises an external casing 10 (preferably made of an electrically insulating material) adapted to be fixed to a supporting structure (not shown).

The external casing 10 advantageously defines an internal volume in which its internal components are accommodated.

The electronic protection device 1 comprises a plurality of input terminals IN and a plurality of output terminals OUT.

The input terminals IN are electrically connected to the electric power source SC. In particular, each input terminal IN is electrically connected to a corresponding conductor P, N of the upstream portion 100A of the electric line, which is in turn electrically connected with the electric power source SC.

The output terminals OUT are electrically connected to the electric load LD. In particular, each output terminal OUT is electrically connected to a corresponding conductor P, N of the load portion 100B of the electric line, which is in turn electrically connected with the electric load LD.

Obviously, the number of input and output terminals IN, OUT depends on the number of conductors of the electric line 100.

The input and output terminals IN, OUT may be formed by conductive connectors positioned at or in proximity of the external casing 10.

The electronic protection device 1 comprises one or more pairs of main contacts 2 advantageously accommodated in the internal volume defined by the external casing 10.

Normally, as shown in the cited figures, the electronic protection device 1 comprises one pair of main contacts 2 for each phase conductor P of the electric line 100 whereas no main contacts 2 are operatively associated with the neutral conductor N.

In the following, the electronic protection device 1 will be described with reference to this case for the sake of simplicity only, without intending to limit the scope of the invention.

In some embodiments of the invention, in fact, the electronic protection device 1 may comprise a pair of main contacts for the neutral conductor N of the electric line 100.

Further alternative solutions, which may be implemented according to the installation needs, are possible and evident to the skilled person.

Each pair of main contacts 2 is electrically connected with corresponding input and output terminals IN, OUT.

The electrical connections between the main contacts 2 and the corresponding input and output terminals IN, OUT can be realized according to solutions known to the skilled person.

The main contacts 2 are adapted to be coupled one with another or to be separated one from another.

When the main contacts 2 are coupled, the current flow between the corresponding input and output terminals IN, OUT is allowed. In this way, a current flow is enabled between the upstream and downstream portions 100A, 100B of the electric line 100 electrically connected with the input and output terminals IN, OUT, respectively.

When the main contacts 2 are separated, the current flow between the corresponding input and output terminals IN, OUT is interrupted. In this way, it is interrupted the current flow between the upstream and downstream portions 100A, 100B of the electric line 100, which are electrically connected with the input and output terminals IN, OUT respectively.

The skilled person will certainly understand how, in operation, all the pairs of main contacts 2 of the electronic protection device are operated in a coordinated manner in a coupled state or in a separated state for obvious purposes of electrical continuity and current balancing.

Each pair of main contacts 2 comprises a main fixed contact 21 and a main movable contact 22.

Preferably, as shown in the cited figures, the main fixed contact 21 is electrically connected with a corresponding output terminal OUT whereas the main movable contact 22 is electrically connected with a corresponding input terminal IN.

However, in some embodiments of the invention, the main fixed contact 21 may be electrically connected with a corresponding input terminal IN and the main movable contact 22 may be electrically connected with a corresponding output terminal OUT.

The electronic protection device 1 comprises a control unit 3 advantageously accommodated in the internal volume defined by the external casing 10.

The control unit 3 comprises a controller 31 that may include data processing resources, preferably of digital type, e.g. one or more microcontrollers.

Preferably, the control unit 3 comprises a signalling device 32 adapted to provide a user with information related to the operating status of the electronic protection device and/or said electric line 100.

Advantageously, the controller 31 is configured to control the operation of the signalling device 2 through the generation of suitable control signals C1.

Preferably, the signalling device 32 comprises one or more LEDs and a circuit interface to drive said LEDs on the base of the control signals C1 received from the controller 31.

According to some embodiments of the invention, the signalling device 32 may comprise a plurality of LEDs, each configured to provide a given light signal indicative of a corresponding operating condition of the electronic protection device, e.g. a light signal indicative of arc fault conditions and a light signal indicative of ground fault conditions, and the like.

According to other embodiments of the invention, the signalling device 32 may comprise a single LED configured to provide a light signal at given blinking patterns, each indicative of a corresponding operating condition of the electronic protection device.

Further variants, e.g. in which the signalling device 32 comprises different arrangements to provide visual signals or arrangements to provide acoustic signals or an HMI, are possible according to the needs.

According to an aspect of the invention, the electronic protection device 1 comprises one or more pairs of auxiliary contacts 4 advantageously accommodated in the internal volume defined by the external casing 10.

Each pair of auxiliary contacts 4 is electrically connected with a corresponding input terminal IN and the control unit 3.

Preferably, as shown in the cited figures, the electronic protection device 1 comprises a pair of auxiliary contacts 4 electrically connected with a corresponding input terminal IN operatively associated with the corresponding phase conductor P and the control unit 3.

In the following, the electronic protection device 1 will be described with reference to this case for the sake of simplicity only, without intending to limit the scope of the invention.

In some embodiments of the invention, in fact, the electronic protection device 1 may comprise a pair of auxiliary contacts 4 electrically connected with an input terminal IN operatively associated with the neutral conductor N and the control unit 3.

Yet in further embodiments of the invention, the electronic protection device 1 may comprise a pair of auxiliary contacts 4 electrically connected with an input terminal IN operatively associated with a phase conductor P and the control unit 3 and a pair of auxiliary contacts 4 electrically connected with the input terminal IN operatively associated with the neutral conductor N and the control unit 3.

Further alternative solutions, which may be implemented according to the installation needs, are possible and evident to the skilled person.

The auxiliary contacts 4 are adapted to be coupled one with another or to be separated one from another.

When the auxiliary contacts 4 are coupled, the control unit 3 receives a power supply from the electric line 100. The controller 31 and other possible devices 32, 33 included in the control unit 2 can thus fully operate.

When the auxiliary contacts 4 are separated, the control unit 3 does not receive any power supply from the electric line 100 and is no more fed. The controller 31 and other possible devices 32, 33 included in the control unit 3 are switched off.

The skilled person will certainly understand how, in operation, all the pairs of auxiliary contacts 4 of the electronic protection device 1 are advantageously operated in a coordinated manner in a coupled state or in a separated state for obvious purposes of electrical continuity. Each pair of auxiliary contacts 4 comprises an auxiliary fixed contact 41 and an auxiliary movable contact 42.

Preferably, as shown in the cited figures, the auxiliary fixed contact 41 is electrically connected with the control unit 3 whereas the auxiliary movable contact 42 is electrically connected with a corresponding input terminal IN.

However, in some embodiments of the invention, the auxiliary fixed contact 41 may be electrically connected with a corresponding input terminal IN and the auxiliary movable contact 42 may be electrically connected with the control unit 3.

The electric protection device 1 comprises a handle 8.

Preferably, the handle 8 is arranged so as to protrude at least partially from the external casing 10.

The handle 8 is movable, preferably around a first rotation axis 520, and it may be actuated by internal members of the electronic protection device, by a user or by external equipment.

The handle 8 is reversibly movable in a first position ON, in a second position TRIP or in a third position OFF, which respectively correspond to the closed state, the tripped state or the open state of the electronic protection device (FIGS. 1-3).

In other words, when the electronic protection device is in the closed state, in the tripped state or in the open state, the handle 8 is positioned in the first position ON, in the second position TRIP or in the third position OFF, respectively.

The electric protection device 1 comprises an operating mechanism 5 advantageously accommodated in the internal volume defined by the external casing 10.

The operating mechanism 5 is operatively connected with the main contacts 2, the auxiliary contacts 4 and the handle 8 and is adapted to interact with these latter.

More particularly, the operating mechanism 5 is adapted to move the main and auxiliary movable contacts 22, 42 so as to couple or separate these latter with or from the corresponding main and auxiliary fixed contacts 21, 41, respectively.

The operating mechanism 5 is adapted to move the handle 8 between the first position ON and the second position TRIP during a given state transition of the electronic protection device and to be actuated by the handle 8 during other state transitions of the electronic protection device.

The electronic protection device 1 comprises a tripping unit 6 adapted to mechanically actuate the operating mechanism 5 in response to an activation by the control unit 3.

The tripping unit 6 is adapted to actuate the operating mechanism 5 in order to make the electronic protection device to pass from the closed state to the tripped state in response to a determination of intervention conditions by the controller 31.

Preferably, when it determines the presence of intervention conditions, the controller 31 generates second control signals C2.

Preferably, as shown in the cited figures, the tripping unit 6 is electrically connected with an output terminal OUT operatively associated with the corresponding phase conductor P and with the output terminal OUT operatively associated with the neutral conductor N (FIGS. 1-3).

Figure 4:
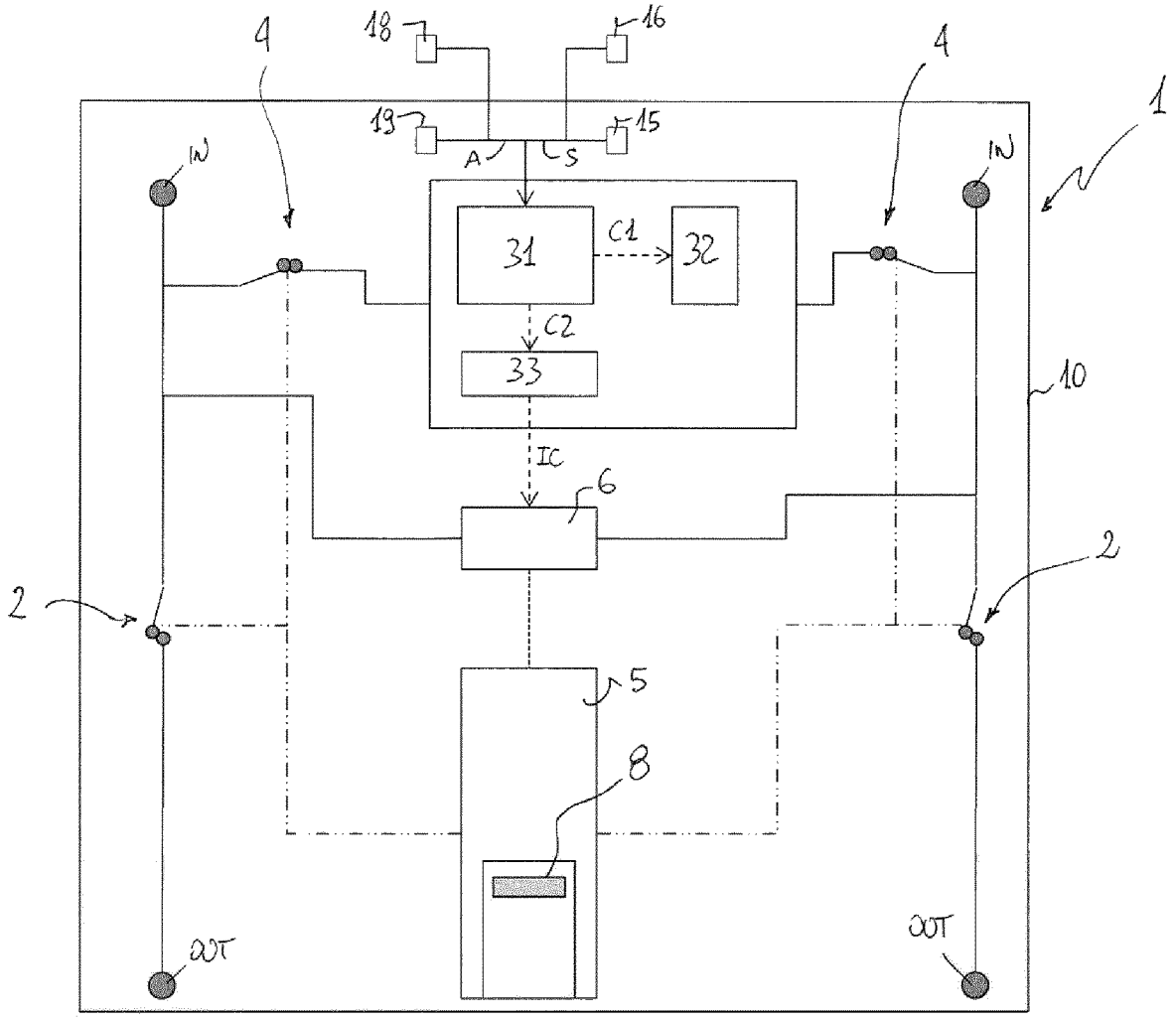
FIG. 4 is a block diagram of a possible alternative embodiment of the electronic protection device, according to the invention.

However, in some embodiments of the invention, the tripping unit 6 may be electrically connected with an input terminal IN operatively associated with the corresponding phase conductor P and with an input terminal IN operatively associated with the neutral conductor N (FIG. 4).

Further alternative solutions, which may be implemented according to the installation needs, are possible and evident to the skilled person.

Preferably, the control unit 3 comprises a driving interface 33 configured to receive the control signals C2 and activate the tripping unit 6 in response of the control signals C2.

Intervention conditions may be determined by the controller 31 if fault conditions (e.g. ground fault conditions, arc fault conditions, shot-circuit conditions, overvoltage conditions, short-delay states, internal faults of the electronic protection device, and the like) in the electric line 100 or in the protection device are present.

The controller 31 may determine the presence of fault conditions upon receiving sensing signals B from internal or external sensing devices 15, 16 (e.g. current sensors) of the electronic protection device, which are operatively associated to the conductors of the electric line 100.

Intervention conditions may be also determined by the controller 31 if this latter receives intervention signals A from external devices 18 or from a test interface 19 (e.g. a test button) of the electronic protection device, which can be manually activated by a user.

Intervention conditions may be even determined by the controller 31 as a result of the execution of a self-test routine or program.

An important aspect of the invention consists in that the control unit 3 is fed also when the electronic protection device is in the tripped state.

According to the invention, the main contacts 2, the auxiliary contacts 4 and the operating mechanism 5 are arranged in such a way that:

- the main contacts 2 and the auxiliary contacts 4 are coupled when the electronic protection device is in the closed state and the handle 8 is in the first position ON;
- the main contacts 2 are separated and the auxiliary contacts 4 are coupled when the electronic protection device is in the tripped state and the handle 8 is in the second position TRIP;
- the main contacts 2 and the auxiliary contacts 4 are separated when the electronic protection device is in the open state and the handle 8 is in the third position OFF.

In accordance to the invention, when the electronic protection device is in the closed state, both the main contacts 2 and the auxiliary contacts 4 are coupled. As the main contacts are in a coupled state, both the upstream and downstream portions 100A, 100B of the electric line are energized and the electric load LD can therefore receive electric power from the electric power source SC. On the other hand, as the auxiliary contacts are in a coupled state, the control unit 3 can receive electric power from the electric line 100.

When the electronic protection device is in the open state, both the main contacts 2 and the auxiliary contacts 4 are separated. As the main contacts are in a decoupled state, the downstream portions 100B of the electric line are de-energized and the electric load LD cannot receive electric power from the electric power source SC. On the other hand, as the auxiliary contacts are in a decoupled state, the control unit 3 cannot receive electric power from the electric line 100.

An important differentiating feature of the electronic protection device 1 with respect to traditional electronic protection devices consists in that the control unit 3 is energized when the electronic protection device is in the tripped state.

When the electronic protection device is in the tripped state, the main contacts 2 are separated. The downstream portions 100B of the electric line 100 are de-energized and the electric load LD cannot receive electric power from the electric power source SC.

Nonetheless, as the auxiliary contacts 4 are in a coupled state, the control unit 3 can receive electric power from the electric line 100, in particular from the upstream portions 100A thereof, which are energized even when the main contacts 2 are separated.

Differently from traditional electronic protection devices, the control unit 3 is therefore able to fully operate even when the electronic protection device 1 is in the tripped state and not only when this latter is in the closed state.

Any device included in the control unit 3 is thus fed and can fully operate.

In particular, the controller 31 can process data and/or interact with devices operatively associated thereto while the signalling device 32 can provide the user with signals indicative of the operating status of the electronic protection device.

In accordance with the invention, the possible operative conditions for the upstream and downstream portions 100A, 100B of the electric line and for some components of the electronic protection device 1 in relation to the operative states thereof, are briefly summarized in the following table:

| | Closed State | Open State | Tripped State |
|---|---|---|---|
| Upstream portions of the electric line | Energized | Energized | Energized |
| Downstream portions of the electric line | Energized | De-Energized | De-Energized |
| Control Unit | Energized | De-Energized | Energized |
| Handle Position | ON | OFF | TRIP |

The possibility of having the control unit 3 fully operative also when the electronic protection device is in the tripped state provides relevant advantages with respect to traditional solutions of the state of the art.

As an example, the control unit 3 can provide the user with information related to the operating status of the electronic protection device, in particular with information related to the possible fault conditions that have caused the automatic transition (tripping) to the tripped state of the electronic protection device.

To this aim, the controller 31 may process the data collected by the sensing devices 15, 16 operatively connected thereto and generate control signals C1 to command the signalling device 32 to provide given light signals S indicative of the possibly identified fault conditions.

As a further example, the control unit 31 can process data related to the current along the conductors of the electric line 100 and/or of the temperature thereof in order to provide estimation data indicative of possible overload conditions in the electric line 100.

Obviously, the control unit 3 can process data and/or interact with other devices operatively connected thereto in order to provide also further functionalities, in accordance to the needs.

As an example, the controller 31 can communicate with other remote devices for the purpose of coordinating the interventions of multiple electronic protection devices in a portion of electric power distribution network including the electric line 100.

In view of the above, it is evident that some relevant operative limitations of the traditional electronic protection devices (when in a tripped state) are definitely overcome.

Further, the electronic protection device 1 is able to provide additional functionalities with respect to currently available electronic protection devices.

As it is no more switched off when the electronic protection device is in the tripped state, the control unit 3 may in fact suitably employ its HW/SW resources in a time phase of the operating life of the electronic protection device, which is substantially precluded to the traditional electronic protection devices.

The electronic protection device 1 is adapted to pass from one of the mentioned operative states to another in accordance with the operative modes that will be described in the following in more details.

The electronic protection device 1 is adapted to automatically (i.e. without the intervention of the user or external equipment) pass from the closed state to the tripped state when the tripping unit 6 mechanically actuates the operating mechanism 5 upon an activation by the control unit 3 (in particular by the driving interface 33) in response to a determination of intervention conditions by the controller 31.

According to an aspect of the invention, the main contacts 2, the auxiliary contacts 4 and the operating mechanism 5 are arranged in such a way that the operating mechanism 5 separates the main contacts 2, maintains coupled the auxiliary contacts 4 and moves the handle 8 from the first position ON to the second position TRIP in response to a mechanical actuation by the tripping unit 6.

The electronic protection device 1 is adapted to pass from the tripped state to the open state only when the handle 8 is mechanically actuated by a user or by external equipment.

According to an aspect of the invention, the main contacts 2, the auxiliary contacts 4 and the operating mechanism 5 are arranged in such a way that the operating mechanism 5 maintains separated the main contacts 2 and separates the auxiliary contacts 4 in response to a movement of the handle 8 from the second position TRIP to the third position OFF.

The electronic protection device 1 is adapted to pass from the closed state to the open state, or vice-versa, only when the handle 8 is mechanically actuated by a user or by external equipment.

According to an aspect of the invention, the main contacts 2, the auxiliary contacts 4 and the operating mechanism 5 are arranged in such a way that the operating mechanism 5 separates the main contacts 2 and separates the auxiliary contacts 4 in response to a movement of the handle 8 from the first position ON to the third position OFF.

According to an aspect of the invention, the main contacts 2, the auxiliary contacts 4 and the operating mechanism 5 are arranged in such a way that the operating mechanism 5 couples the main contacts 2 and couples the auxiliary contacts 4 in response to a movement of the handle 8 from the third position OFF to the first position ON.

In the cited figures, partial schematic views of an embodiment of the electronic protection device 1 are illustrated.

Preferably, the operating mechanism 5 comprises a handle shaft 52 accommodated in the internal volume defined by the external casing 10 and configured to rotate about the first rotation axis 520.

Advantageously, the handle 8 is fixed to or integral with the handle shaft 52 so as to rotationally move together with this latter.

Advantageously, the one or more auxiliary movable contacts 42 of the electronic protection device are fixed to the handle shaft 52 so as to move solidly with this latter.

Preferably, the operating mechanism 5 comprises a first elastic element 53 that is operatively coupled with the handle shaft 52 and a fixed support (e.g. the external casing 10) in such a way to exert a force to rotate the handle shaft 52 (and the handle 8 fixed thereto) according to a given rotation direction R1.

Preferably, the first elastic element 53 is formed by a spring (e.g. a torsion spring) having its ends operatively coupled with the handle shaft 52 and the fixed support 10.

Preferably, the operating mechanism 5 comprises a movable contact shaft 54 adapted to rotate about a second rotation axis 540.

Advantageously, the one or more main movable contacts 22 of the electronic protection device are joined to the movable contact shaft 54 so as to move together with this latter.

Preferably, the operating mechanism 5 comprises a second elastic element 55 operatively coupled with the movable contact shaft 54 and a fixed support (e.g. the external casing 10) in such a way to exert a force to rotate the movable shaft 54 according to the rotation direction R1.

Preferably, the second elastic element 55 is formed by a spring (e.g. a torsion spring) having its ends operatively coupled with the movable contact shaft 54 and the fixed support 10.

Preferably, the movable contact shaft 54 comprises a latching portion 541 and a support portion 542 that are mutually hinged at the second rotation axis 540.

The latching portion 541 is adapted to receive an actuation force from the tripping unit 6, when this latter is activated by the control unit 3.

The support portion 542 is adapted to accommodate and support the one or more main movable contacts 22 of the electronic protection device.

The latching and support portions 541, 542 of the movable contact shaft are movable one respect to another. In particular, they can relatively move by rotating about the second rotation axis 540 according to opposite diverging or converging directions in order to separate from another or to couple one with another, respectively.

Preferably, the operating mechanism 5 comprises a third elastic element 58 operatively coupled with the latching and support portions 541, 542 in such a way to exert a force to maintain coupled these latter. In particular, the force exerted by the third elastic element 58 is directed to rotate the latching and support portions 541, 542 according to opposite converging directions.

Preferably, the third elastic element 58 is formed by a spring (e.g. a torsion spring) having its ends operatively coupled with the latching and support portions 541, 542.

Preferably, the movable contact shaft 54 comprises a connection slot 57 for the connection with a further member of the operating mechanism 5.

Preferably, the latching and support portions 541, 542 respectively comprise first and second coupling surfaces 541A, 542A, which advantageously define at least partially the connection slot 57.

The first and second coupling surfaces 541A, 542A are adapted to be mutually coupled or separated in response to the relative movements of the latching and support portions 541, 542.

Advantageously, the first and second coupling surfaces 541A, 542A are mutually positioned so that the force exerted by the third elastic element 58 is directed to maintain them coupled.

Preferably, the operating mechanism 5 comprises a connecting rod 56 adapted to operatively connect the handle shaft 52 and the movable contact shaft 54.

Preferably, the connecting rod 56 has a first end 561 joined to the handle shaft 52 and a second end 562 slidingly coupled with the movable contact shaft 54 at the connection slot 57.

Preferably, the first and second coupling surfaces 541A, 542A are coupleable with the second end 562 of the connecting rod 56.

When they couple with the second end 562 of the connecting rod, the first and second coupling surfaces 541A, 542A are capable to block the second end 562 in a hinging position F within the connection slot 57, preferably at one end of this latter.

As it will be better illustrated in the following, the coupling between the coupling surfaces 541A, 542A and the second end 562 of the connecting rod occurs when the handle 8 is in the first position ON or in the third position OFF.

When the handle 8 is in the second position TRIP, the second end 562 of the connecting rod 56 is free to slide along the connection slot 57.

According to the embodiment shown in the cited figures, each of the one or more main fixed contacts 21 is formed by a first fixed conductive element (e.g. a first conductive shaped plate) electrically connected with a corresponding output terminal OUT by means of an electrical connection of known type (not shown).

Each of the one or more main movable contacts 22 is formed by a first movable conductive element (e.g. a shaped conductive arm) joined to the movable contact shaft 54 and electrically connected with a corresponding input terminal IN by means of an electrical connection of known type (not shown).

According to the embodiment shown in the cited figures, each of the one or more auxiliary fixed contacts 41 is formed by a second fixed conductive element (e.g. a second conductive shaped plate) electrically connected with the control unit 3 by means of an electrical connection of known type (not shown).

Each of the one or more auxiliary movable contacts 42 is formed by a second movable conductive element fixed to the handle shaft 52 and electrically connected with a corresponding input terminal IN by means of an electrical connection that may be of known type.

Preferably, as shown in the cited figures, such an electrical connection may comprise a conductive wire 451 electrically connected with a third fixed conductive shaped plate 452 electrically connected with an input terminal IN and in permanent sliding contact with the movable conductive element 42.

Advantageously, the second movable conductive element 42 is shaped in such a way to be coupled with the first conductive element 41, when the handle 8 is the first position ON or in the second position TRIP, and to be separated from the fixed conductive element 41, when the handle 8 is in the third position OFF.

Preferably, the second movable conductive element 42 is formed by a conductive wire having ends fixed to the handle shaft 52 and shaped in such a way to form an eccentric arc with respect to the first rotation axis 520.

In this way, the conductive wire 42 can move eccentrically with respect to the rotation center 520 and can slidingly couple with the conductive plate 41 only when the handle 8 is the first position ON or in the second position TRIP and, at the same time, remain in permanent sliding contact with the conductive plate 452.

According to the embodiment shown in the cited figures, the tripping unit 6 comprises an actuator of the electromagnetic type (e.g. a solenoid).

Preferably, the tripping unit 6 comprises an actuation coil (not shown) and a movable plunger 62.

Preferably, the actuation coil is accommodated in an enclosure 61.

Preferably, the tripping unit 6 is activated when the driving interface 33 of the control unit 33 provides a supply current IC to the actuation coil in order to determine the translational movement of the movable plunger 62 thanks to the force exerted on the plunger by the electromagnetic field generated by the supply current IC.

Preferably, the driving interface 33 may comprise a power supply circuit controlled by a switch (e.g. a SCR switch), which is in turn controlled by the controller 31.

Preferably, the tripping unit 6 (in particular the movable plunger 62) is adapted to actuate the movable contact shaft 54, in particular the latching portion 541 thereof.

The operation of the electronic protection device 1, according to the embodiment shown in the cited figures, is illustrated in more details.

Figure 5:
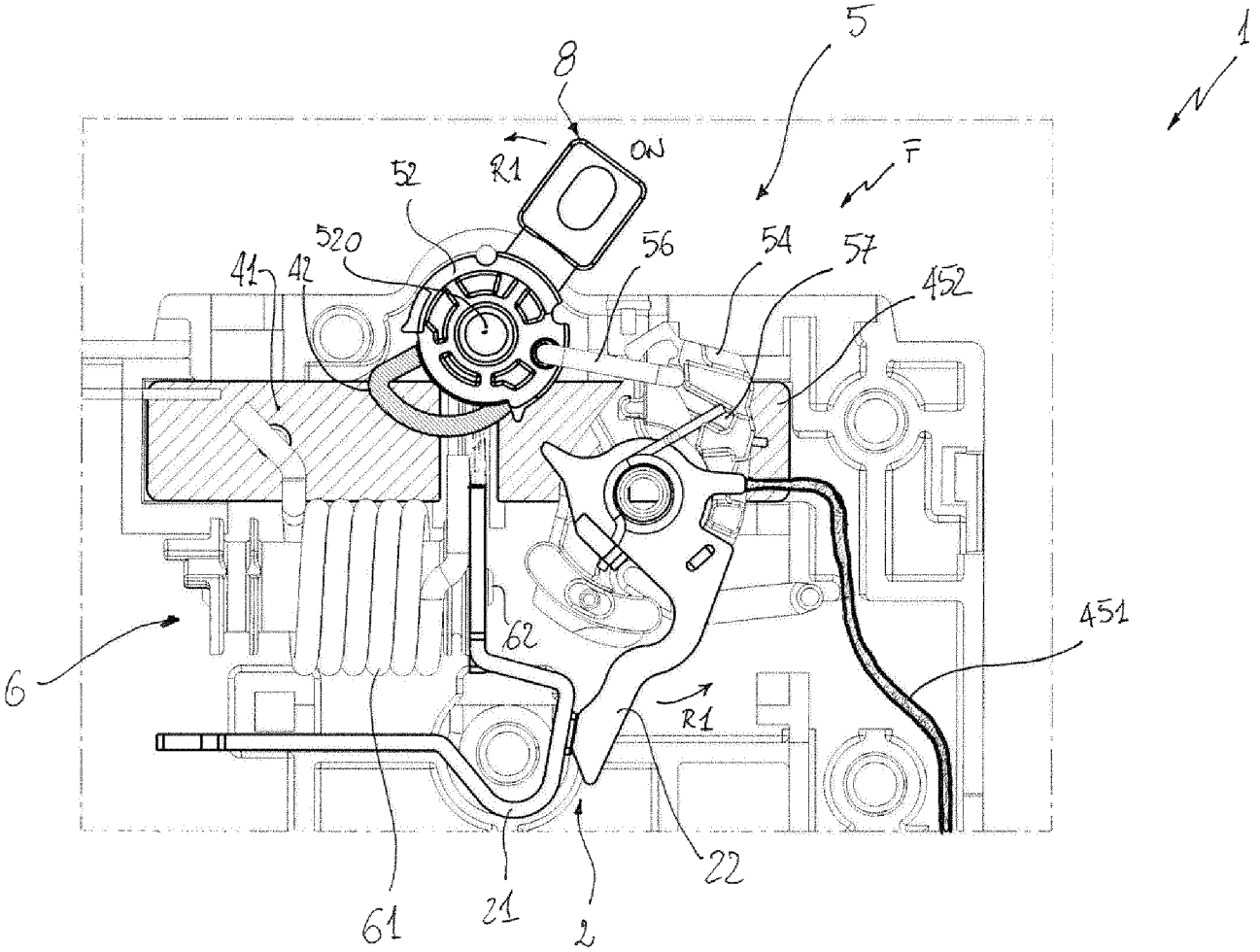
FIG. 5 is a partial view of the operating mechanism of the electronic protection device of FIG. 1 in a closed state.

Transition of the Electric Protection Device from the Closed State to the Tripped State The electronic protection device 1 is initially in a closed state (FIG. 5).

In this situation:

- the main movable contact 22 is coupled with the main fixed contact 21;
- the auxiliary movable contact 42 is electrically connected with the auxiliary fixed contact 41;
- the second elastic element 55 is charged but it is prevented from actuating the movable contact shaft 54, as this latter is positioned in suitable balancing point at which the second elastic element 55 cannot intervene;

the second end 562 of the connecting rod 56 is blocked by the coupling surfaces 541A, 542A in the hinging position F within the connection slot 57;

the first elastic element 53 is charged but it is prevented from actuating the handle shaft 52, as this latter is positioned in suitable balancing point, at which the first elastic element 53 cannot intervene;

the handle 8 is in the first position ON.

The tripping unit 6 is activated by the control unit 3.

The movable plunger 62 translates and exerts a force on the latching portion 541, which slightly separates from the support portion 542 in contrast with the force exerted by the third elastic element 58.

This causes the separation of the first and second coupling surfaces 541A, 542A, which leave the second end 562 of the connecting rod 56 free to move away from the hinging position F.

The second end 562 of the connecting rod can thus slide along the connection slot 57.

Due to the movement of the second end 562 of the connecting rod, the movable contact shaft 54 is free to rotate according to the rotation direction R1.

The second elastic element 55 provides the actuation force to complete the rotation of the movable contact shaft 54 and the consequent separation of the movable main contact 22 from the fixed main contact 21.

Due to the movement of the second end 562 of the connecting rod, the handle shaft 52 is free to rotate.

The first elastic element 53 provides the actuation force to rotate the handle shaft 52 according to the rotation direction R1.

The handle shaft 52 and the movable contact shaft 54 are operatively connected in such a way that, in this case, the handle shaft 52 abuts against the movable contact shaft 54 during its rotation.

At this point, the handle shaft 52 stops its rotation as the force exerted by the first elastic element 53 is not sufficient to move away the handle shaft 52 from the abutting position with the movable contact shaft 54.

During the movement of the handle shaft 52, the handle 8 rotates with the handle shaft 52 and reaches the second position TRIP while the auxiliary movable contact 42 remains electrically connected (sliding connection) with the auxiliary fixed contact 41 and with the conductive plate 452.

Figure 6:
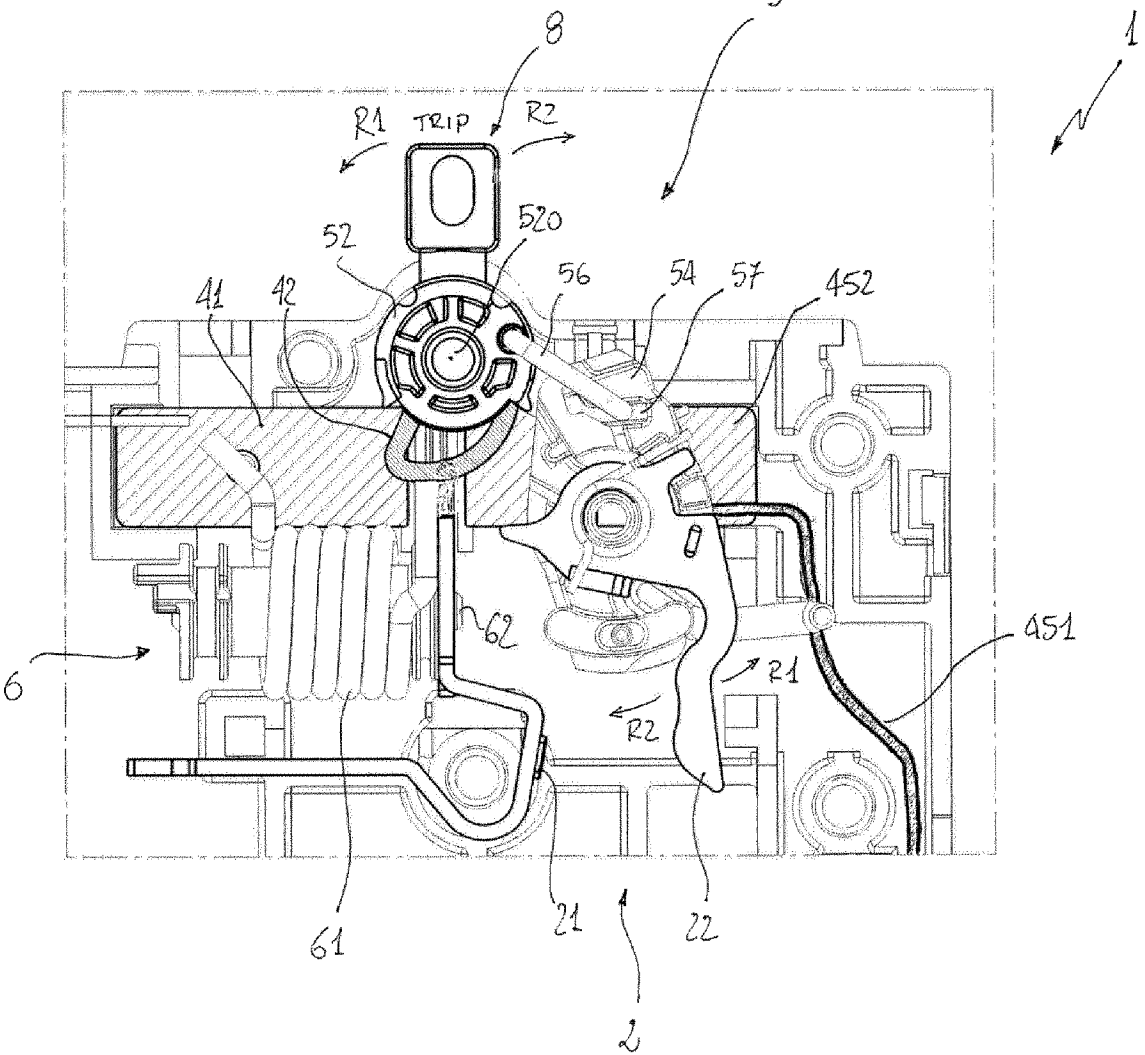
FIG. 6 is a partial view of the operating mechanism of the electronic protection device of FIG. 1 in a tripped state.

The electronic protection device 1 is now transitioned into the tripped state (FIG. 6).

In this situation:

the main movable contact 22 is separated the fixed contact 21;

the auxiliary movable contact 42 is electrically connected with the auxiliary fixed contact 41;

the second elastic element 55 is substantially discharged (unless its installation charging bias);

the second end 562 of the connecting rod 56 is free to slide within the connection slot 57;

the first elastic element 53 is still partially charged but it is prevented from actuating the handle shaft 52, as this latter is in an abutting position with the movable contact shaft 54;

the handle 8 is in the second position TRIP.

Transition of the Electric Protection Device from the Tripped State to the Open State The electronic protection device 1 is initially in the tripped state (FIG. 6).

The handle 8 is mechanically actuated by a user or by external equipment.

The actuation force exerted on the handle 8 moves away the handle shaft 52 from the abutting position with the movable contact shaft 54.

The first elastic element 53 and possibly the actuated handle 8 provide the actuation force to complete the rotation of the handle shaft 52.

Due to the relative movement between the handle shaft 52 and the movable contact shaft 54, the second end 562 of the connecting rod 56 slides along the connection slot 57 and returns in the hinging position F, at which it is blocked by the coupling surfaces 541A, 542A.

Due to the rotation movement of handle shaft 52, the auxiliary movable contact 42 is separated from the auxiliary fixed contact 41.

The handle 8 rotates with the handle shaft 52 and reaches the third position OFF.

Figure 7:
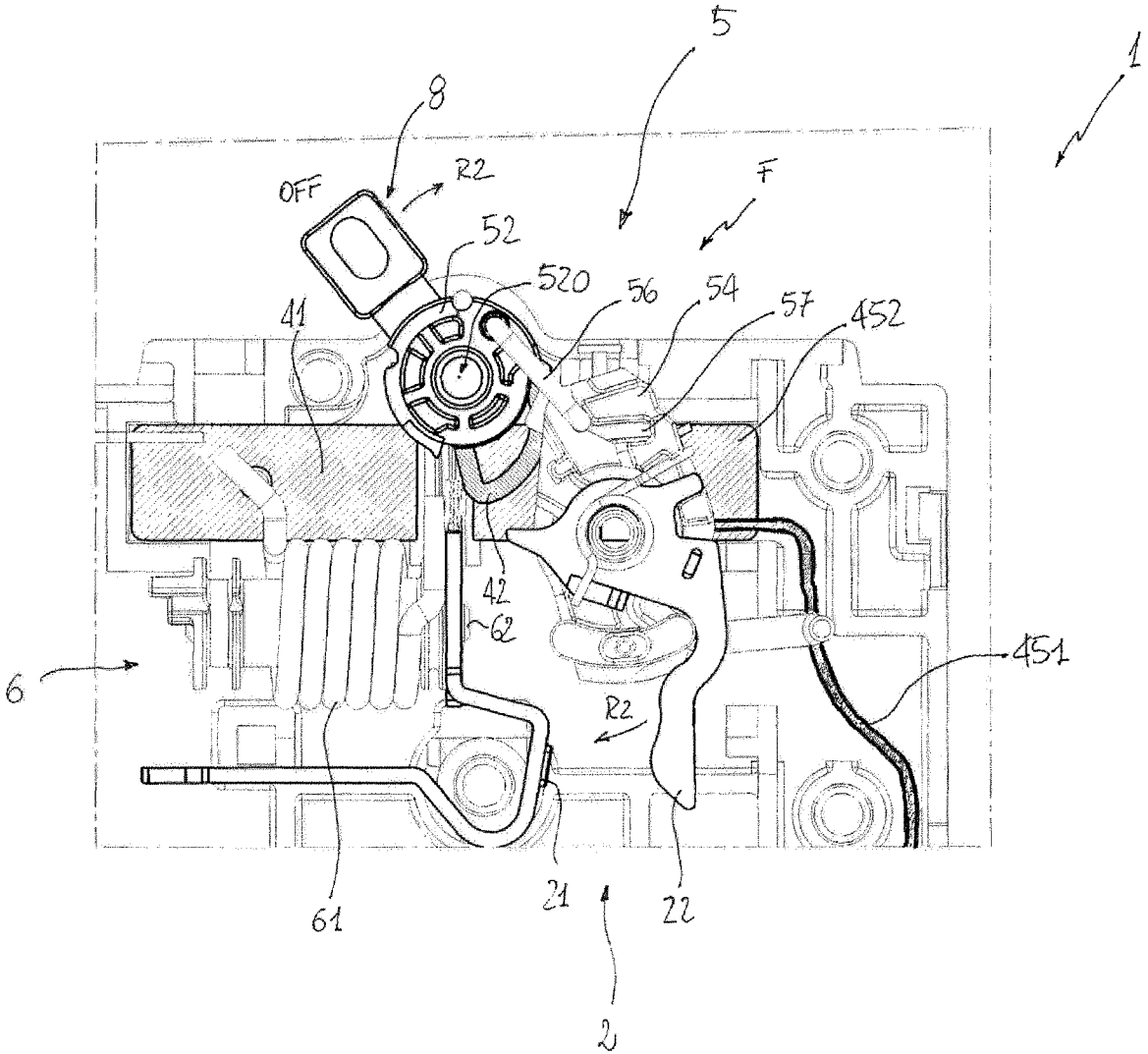
FIG. 7 is a partial view of the operating mechanism of the electronic protection device of FIG. 1 in an open state.
Figure 8:
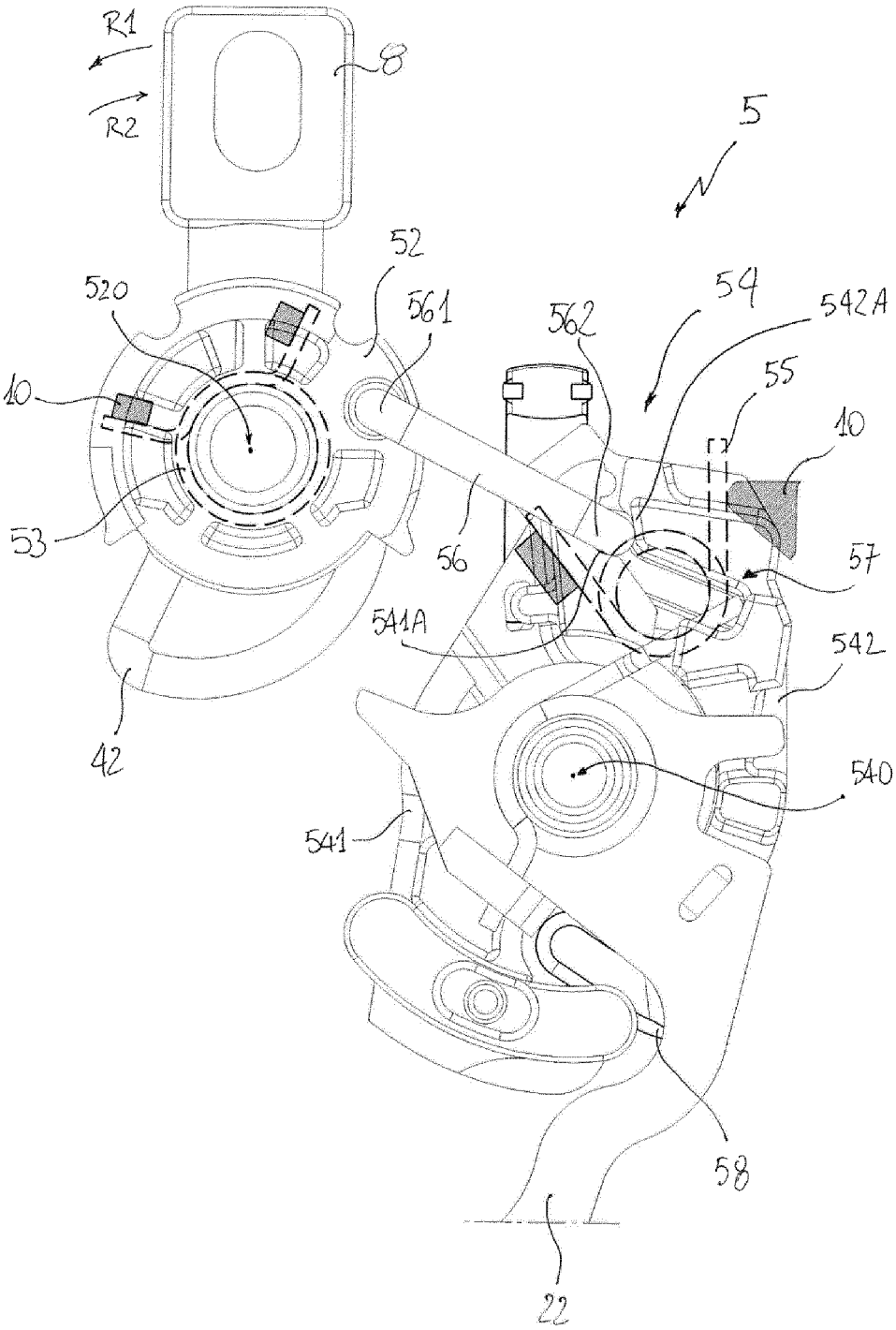
FIG. 8 is a further partial view of the operating mechanism of the electronic protection device of FIG. 1.
Figure 9:
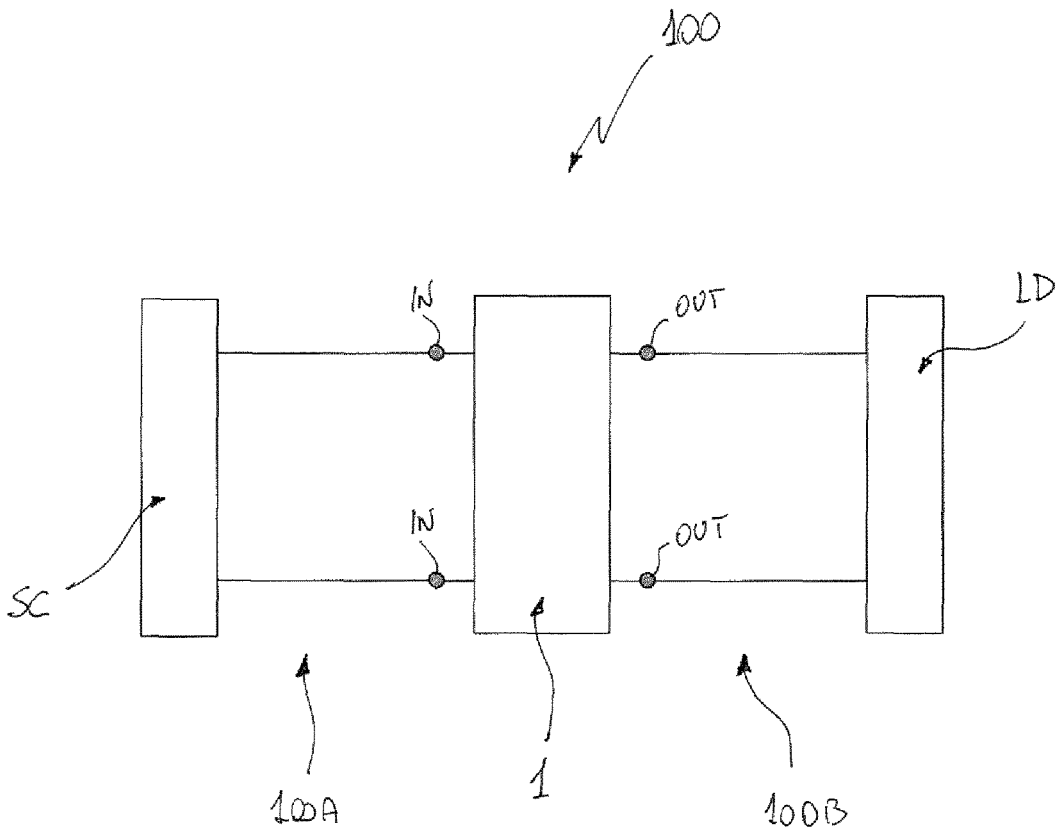
FIG. 9 is a block diagram of a LV electric line to which an electronic protection device, according to the invention, is operatively associated.

The electronic protection device 1 is now transitioned into the open state (FIG. 7).

In this situation:

the main movable contact 22 is separated the fixed contact 21;

the auxiliary movable contact 42 is separated from the auxiliary fixed contact 41;

the first elastic element 53 is substantially discharged (unless its installation charging bias);

the second elastic element 55 is substantially discharged (unless its installation charging bias);

the second end 562 of the connecting rod 56 is blocked by the coupling surfaces 541A, 542A in the hinging position F within the connection slot 57;

the handle 8 is in the third position OFF.

Transition of the Electric Protection Device from the Closed State to the Open State The electronic protection device 1 is initially in a closed state (FIG. 5).

The handle 8 is mechanically actuated by a user or by external equipment.

Owing to the actuation force exerted on the handle 8, the handle shaft 52 rotates according to the direction rotation R1.

The handle shaft 52 and the movable contact shaft 54 are operatively connected in such a way that, in this case, the handle shaft 52 does not abut against the movable contact shaft 54 during its rotation and the movable contact shaft 54 initially rotates according to the rotation direction R2 until the handle shaft 52 reaches a given rotation point.

As soon as the handle shaft 52 passes over such a given rotation point, the movable contact shaft 54 is free to rotate according to the rotation direction R1.

The first elastic element 53 and possibly the actuated handle 8 provide the actuation force to complete the rotation of the handle shaft 52.

The handle 8 rotates with the handle shaft 52 and reaches the third position OFF (passing through the second position TRIP) while the auxiliary movable contact 42 is separated from the auxiliary fixed contact 41.

At the same time, the second elastic element 55 provides the actuation force to complete the rotation of the movable contact shaft 54 and the consequent separation of the movable main contact 22 from the fixed main contact 21.

During the movement of the movable contact shaft 54, the second end 562 of the connecting rod 56 remains blocked in the hinging position F.

The electronic protection device 1 is now transitioned into the open state (FIG. 7).

Transition of the Electric Protection Device from the Open State to the Closed State The electronic protection device 1 is initially in an open state (FIG. 7).

The handle 8 is mechanically actuated by a user or by external equipment.

The actuation force exerted on the handle 8 rotates the handle shaft 52 according to the rotation direction R2 (opposite to the rotation direction R1) against the force exerted by the first elastic element 53.

The handle shaft 52 rotates until it reaches a suitable balancing point at which the first elastic element 53 is prevented from actuating it.

The handle 8 rotates with the handle shaft 52 and reaches the first position ON (passing through the second position TRIP) while the auxiliary movable contact 42 is coupled the auxiliary fixed contact 41.

The actuation force exerted on the handle 8 is transmitted (through the connecting rod 56) to the movable contact shaft 54, which rotates according to the rotation direction R2 against the force exerted by the second elastic element 55.

The movable contact shaft 54 rotates until the main movable contact 22 couples with the main fixed contact 21.

At this point, the movable contact shaft 54 reaches a suitable balancing point, at which the second elastic element 55 is prevented from actuating it.

During the movement of the movable contact shaft 54, the second end 562 of the connecting rod 56 remains blocked in the hinging position F.

The electronic protection device 1 is now transitioned into the closed state (FIG. 5).

In practice it has been found that the electronic protection device, according to the invention, fully achieves the intended aim and objects.

In the electronic protection device 1, the control unit 3 is still able to operate even when said electronic protection device is in a tripped state.

The control unit 3 can thus be fully employed to provide data processing and/or control functionalities in accordance to the needs.

For example, the control unit 3 can suitably control the signalling device 22 in order to provide the user with information related to the operating state of the electronic protection device and/or the electric line even after the tripping of the electronic protection device.

The user can therefore be informed about the real nature of possible faults causing the tripping of the electronic protection device.

In this way, possible maintenance intervention may be properly addressed.

The electronic protection device 1 has a compact structure with respect to currently available electronic protection devices.

The electronic protection device 1 has proven to be easy to industrially manufacture, at competitive costs with respect to currently available electronic protection devices.

The invention claimed is:

1. An electronic protection device for a LV electric line including at least a phase conductor (P) and a neutral conductor (N), comprising:

input terminals (IN) and output terminals (OUT), at which said electronic protection device is electrically connected respectively with an electric power source (SC) and with an electric load (LD) through said phase and neutral conductors (P, N);

a control unit comprising a controller including data processing resources;

one or more pairs of main contacts electrically connected with corresponding one or more input and output terminals (IN, OUT) and adapted to be mutually coupled or separated;

one or more pairs of auxiliary contacts electrically connected with corresponding one or more input terminals (IN) and with said control unit and adapted to be mutually coupled or separated;

a handle movable in a first position (ON) corresponding to a closed state of said electronic protection device, in a second position (TRIP) corresponding to a tripped state of said electronic protection device or in a third position (OFF) corresponding to an open state of said electronic protection device;

an operating mechanism adapted to operate said main contacts, said auxiliary contacts and said handle;

a tripping unit adapted to actuate said operating mechanism in response to an activation by said control unit;

wherein:

said main contacts and said auxiliary contacts are coupled when said electronic protection device is in said closed state with said handle in said first position (ON);

said main contacts are separated and said auxiliary contacts are coupled when said electronic protection device is in said tripped state with said handle in said second position (TRIP);

said main contacts and said auxiliary contacts are separated when said electronic protection device is in said open state with said handle in said third position (OFF).

2. The electronic protection device, according to claim 1, wherein said operating mechanism is adapted to separate said main contacts, maintain coupled said auxiliary contacts and move said handle from said first position (ON) to said second position (TRIP) in response to an actuation of said operating mechanism by said tripping unit.

3. The electronic protection device, according to claim 1, wherein said operating mechanism is adapted to maintain separated said main contacts and separate said auxiliary contacts in response to a movement of said handle from said second position (TRIP) to said third position (OFF).

4. The electronic protection device, according to claim 1, wherein said operating mechanism is adapted to separate said main contacts and separate said auxiliary contacts in response to a movement of said handle from said first position (ON) to said third position (OFF).

5. The electronic protection device, according to claim 1, wherein said operating mechanism is adapted to couple said main contacts and couple said auxiliary contacts in response to a movement of said handle from said third position (OFF) to said first position (ON).

6. The electronic protection device, according to claim 1, wherein said control unit comprises a signalling device controlled by said controller, said signalling device being adapted to provide a user with information (S) related to the operating status of said electronic protection device and/or said electric line.

7. The electronic protection device, according to claim 6, wherein said signalling device comprises one or more LEDs to provide light signals (S) indicative of the operating status of said electronic protection device.

8. The electronic protection device, according to claim 1, wherein:

each pair of main contacts comprises a main fixed contact and a main movable contact adapted to be coupled with or separated from said main fixed contact;

each pair of auxiliary contacts comprises an auxiliary fixed contact and an auxiliary movable contact adapted to be coupled with or separated from said auxiliary fixed contact, said one or more auxiliary movable contacts being solidly movable with said handle.

9. The electronic protection device, according to claim 8, wherein said operating mechanism comprises:

a handle shaft adapted to rotate about a first rotation axis, said handle and said auxiliary movable contact being fixed to said handle shaft so as to move solidly with said handle shaft about said first rotation axis, said operating mechanism comprising a first elastic element operatively coupled with said handle shaft and a fixed support and adapted to exert a force to rotate said handle shaft according to a given rotation direction (R1);

a movable contact shaft adapted to rotate about a second rotation axis, said one or more main movable contacts operatively coupled with said movable contact shaft so as to move together with said movable contact shaft about said second rotation axis, said operating mechanism comprising a second elastic element operatively coupled with said movable contact shaft and a fixed support and adapted to exert a force to rotate said movable shaft according to said given rotation direction (R1);

a connecting rod adapted to operatively connect said handle shaft and said movable contact shaft, said connecting rod having a first end joined to said handle shaft and a second end slidingly coupled with said movable contact shaft at a connection slot of said movable contact shaft.

10. The electronic protection device, according to claim 9, wherein said movable contact shaft comprises a latching portion adapted to be actuated by said tripping unit and a support portion adapted to support said one or more main movable contacts, said latching and support portions being mutually hinged at said second rotation axis and being movable one respect to another about said second rotation axis, said latching portion and support portions comprising first and second coupling surfaces that can be mutually coupled or separated, said operating mechanism comprising a third elastic element operatively coupled with said latching portion and support portions and adapted to exert a force to maintain coupled said coupling surfaces.

11. The electronic protection device, according to claim 9, wherein said first and second coupling surfaces are adapted to couple with the second end of said connecting rod to block the second end of said connecting rod in a hinging position (F) within said connection slot, when said handle is in said first position (ON) or in said third position (OFF).

12. The electronic protection device, according to claim 8, wherein said each of said auxiliary movable contacts is formed by a conductive wire having ends fixed to said handle shaft and shaped in such a way to form an eccentric are with respect to said first rotation axis.

13. The electronic protection device, according to claim 2, wherein said operating mechanism is adapted to maintain separated said main contacts and separate said auxiliary contacts in response to a movement of said handle from said second position (TRIP) to said third position (OFF).

14. The electronic protection device, according to 2, wherein said operating mechanism is adapted to separate said main contacts and separate said auxiliary contacts in response to a movement of said handle from said first position (ON) to said third position (OFF).

15. The electronic protection device, according to claim 3, wherein said operating mechanism is adapted to separate said main contacts and separate said auxiliary contacts in response to a movement of said handle from said first position (ON) to said third position (OFF); and wherein said operating mechanism is adapted to separate said main contacts, maintain coupled said auxiliary contacts and move said handle from said first position (ON) to said second position (TRIP) in response to an actuation of said operating mechanism by said tripping unit.

16. The electronic protection device, according to claim 2, wherein said operating mechanism is adapted to couple said main contacts and couple said auxiliary contacts in response to a movement of said handle from said third position (OFF) to said first position (ON).

17. The electronic protection device, according to claim 4, wherein said operating mechanism is adapted to couple said main contacts and couple said auxiliary contacts in response to a movement of said handle from said third position (OFF) to said first position (ON);

wherein said operating mechanism is adapted to separate said main contacts, maintain coupled said auxiliary contacts and move said handle from said first position (ON) to said second position (TRIP) in response to an actuation of said operating mechanism by said tripping unit; and wherein said operating mechanism is adapted to maintain separated said main contacts and separate said auxiliary contacts in response to a movement of said handle from said second position (TRIP) to said third position (OFF).

18. The electronic protection device, according to claim 2, wherein said control unit comprises a signalling device controlled by said controller, said signalling device being adapted to provide a user with information (S) related to the operating status of said electronic protection device and/or said electric line.

19. The electronic protection device, according to claim 3, wherein said control unit comprises a signalling device controlled by said controller, said signalling device being adapted to provide a user with information (S) related to the operating status of said electronic protection device and/or said electric line.

20. The electronic protection device, according to claim 10, wherein said first and second coupling surfaces are adapted to couple with the second end of said connecting rod to block the second end of said connecting rod in a hinging position (F) within said connection slot, when said handle is in said first position (ON) or in said third position (OFF).

* * * * *